United States Patent [19]

Darr

[11] Patent Number: 5,020,692

[45] Date of Patent: Jun. 4, 1991

[54] CONTAINER INCLUDING UNITARY BLOW MOLDED BOTTLE HAVING DRAIN-BACK DISPENSING SPOUT AND PLASTIC INSERT

[75] Inventor: Richard C. Darr, Seville, Ohio

[73] Assignee: Plastipak Packaging, Inc., Plymouth, Mich.

[21] Appl. No.: 196,041

[22] Filed: May 19, 1988

Related U.S. Application Data

[62] Division of Ser. No. 863,686, May 15, 1986, abandoned.

[51] Int. Cl.[5] ..... B67D 1/16

[52] U.S. Cl. ..... 222/109; 141/381; 264/533; 222/482; 222/566

[58] Field of Search ..... 264/531, 533, 534; 425/525; 215/1 C, 31, 356; 222/109, 482, 566, 111; 141/380, 381

[56] References Cited

U.S. PATENT DOCUMENTS

| | | | |
|---|---|---|---|
| 1,794,098 | 2/1931 | Aulbach et al. | 222/109 |
| 4,419,323 | 12/1983 | Winchell | 425/525 |
| 4,550,862 | 11/1985 | Baker et al. | 222/109 |
| 4,616,759 | 10/1986 | Matler | 141/381 |

*Primary Examiner*—H. Grant Skaggs
*Attorney, Agent, or Firm*—Brooks & Kushman

[57] ABSTRACT

A container (20,20') is disclosed as having a unitary plastic blow molded bottle (22,22') which has a dispensing spout (32) projecting upwardly from a hollow body portion (26) and also has a moat (34) that surrounds the dispensing spout such that securement of a measuring cup (24,24') to the bottle in a sealed relationship permits excess liquid contents in the measuring cup to drain back into the bottle through an opening (36) in the moat. The unitary blow molded bottle is preferably constructed with the moat (34) inclined and having the opening (36) at a lower portion of the moat. In one embodiment of the container (20), retainers (42) on the dispensing spout (32) secure retainers (44) on the measuring cup (24) to secure the measuring cup with round sealing surfaces (52,54) on the bottle and the measuring cup sealing about the moat (34). In another embodiment, an annular insert (100) surrounds the moat (34) and has retainers (106) that secure retainers (108) on the cup (24') to provide sealing between a round sealing surface (112) on the insert and a round sealing surface (114) on the cup.

6 Claims, 3 Drawing Sheets

Fig. 4
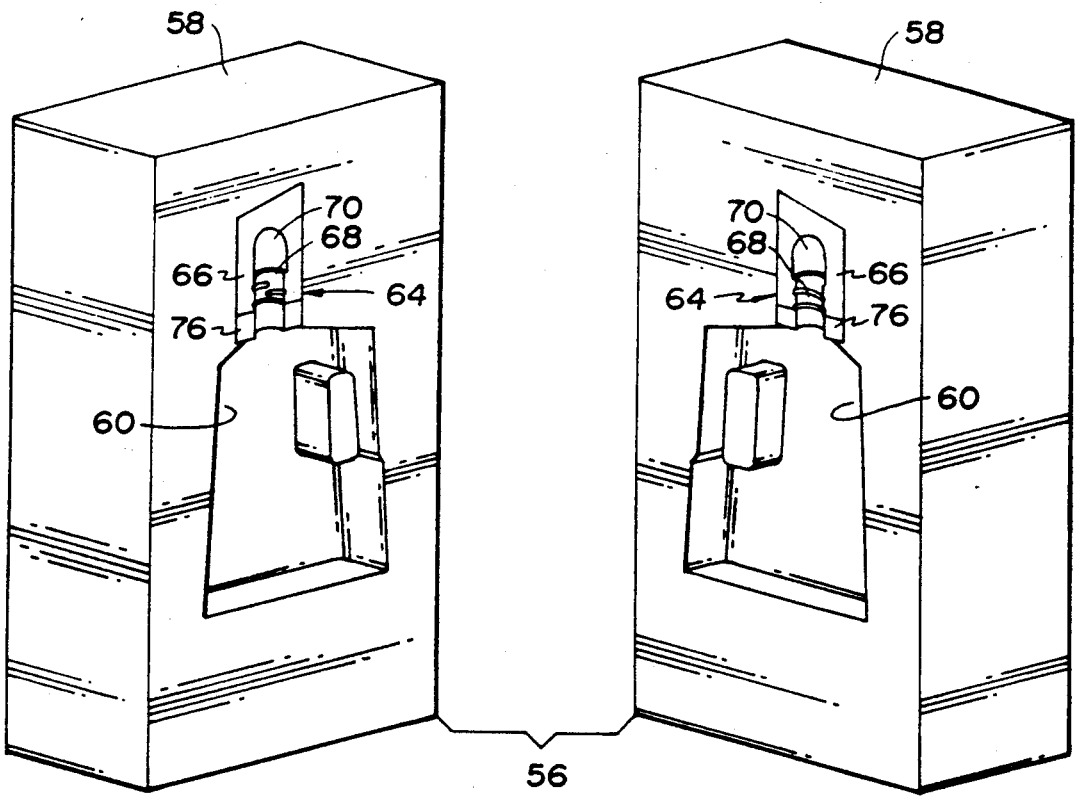
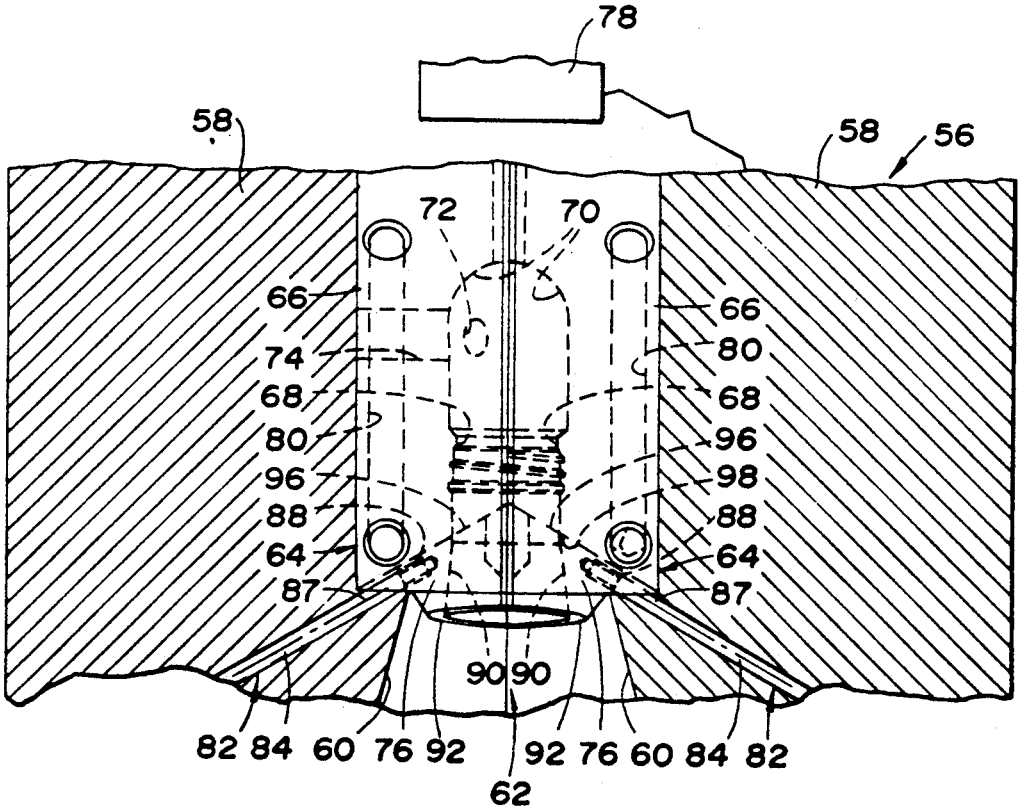
Fig. 5

CONTAINER INCLUDING UNITARY BLOW MOLDED BOTTLE HAVING DRAIN-BACK DISPENSING SPOUT AND PLASTIC INSERT

This is a divisional of application Ser. No. 863,686, filed on May 15, 1986, now abandoned.

TECHNICAL FIELD

This invention relates to a container including a blow molded bottle for storing liquid contents and also including a measuring cup for dispensing measured amounts of the liquid contents.

BACKGROUND ART

Currently available packages for liquids include a container for storing the liquid and a measuring cup that is secured to a transition collar mounted on a finish of the container. This transition collar is conventionally manufactured as either a one-piece or two-piece plastic injection molding and includes a central pouring spout as well as an outer wall and an intermediate drain between the pouring spout and the outer wall. After pouring a measured amount of the liquid from the container into the measuring cup and thereafter pouring the liquid out of the cup for dispensing, the measuring cup is secured to the transition collar such that any remaining liquid in the cup drains through the transition collar back into the container. The cost of manufacturing the drain for the container as a result of the injection molding of the transition collar necessarily adds to the resultant cost of the product to the consumer.

Other liquid packages and the like are disclosed by U.S. Pat. Nos.: 2,061,685 Wheaton; 2,601,039 Livingstone; 3,369,710 Lucas; 4,078,700 Hidding; 4,128,189 Baxter; 4,273,247 Earls; 4,298,145 Iida; 4,349,056 Heino; 4,436,269 Dirksing et al; and 4,516,689 Barker.

DISCLOSURE OF INVENTION

An object of the present invention is to provide an improved and economical container for storing liquid contents and for dispensing measured amounts of the liquid contents. In carrying out this object, the container includes a unitary plastic blow molded bottle whose construction provides a drain-back feature when utilized in association with a measuring cup of the container. The drain-back feature of the container is thus provided by the unitary blow molded bottle as opposed to providing the drain-back feature by use of a separate injection molded transition collar of the type utilized by the prior art.

The container of the invention, as mentioned above, includes a unitary plastic blow molded bottle including a hollow body portion for holding liquid contents and also including a dispensing spout that projects upwardly from the body portion to permit dispensing of the liquid contents by tilting of the bottle. The bottle also has a moat that extends around the spout and has an opening communicated with the interior of the hollow body portion. A measuring cup of the container is securable to the blow molded bottle in a sealed relationship about the moat such that liquid contents remaining in the measuring cup upon securement to the bottle will drain into the moat and through the opening thereof back into the hollow body portion of the bottle.

In the preferred construction, the moat has a round shape that is inclined and includes an upper portion and a lower portion, while the opening of the moat is located at the lower portion of the moat to increase the effectiveness of the drain-back flow of liquid contents remaining in the measuring cup. Also, the preferred construction of the moat includes a pair of inclined walls. Each of the inclined walls has a generally crescent shape oriented in the opposite direction as the crescent shape of the other moat wall.

In one embodiment, the dispensing spout includes at least one retainer, and the measuring cup also includes at least one retainer that is retained by the retainer of the spout to secure the measuring cup on the container. Both the measuring cup and the moat include round sealing surfaces that engage each other to seal about the moat with the measuring cup secured by the retainers.

In another embodiment, the container also includes an annular insert that extends around the moat and has at least one retainer, while the measuring cup has an annular wall that also includes at least one retainer that is retained by the retainer of the insert to secure the measuring cup to the container. Both the annular insert and the measuring cup include round sealing surfaces that engage each other with the measuring cup secured to the container.

In both disclosed embodiments, the retainers are illustrated as being embodied by retaining threads. However, it should be appreciated that other type of retainers can also be utilized such as retaining lugs or the like even though the retaining threads provide best results.

The objects, features, and advantages of the present invention are readily apparent from the following detailed description of the best modes for carrying out the invention when taken in connection with the accompanying drawings.

BRIEF DESCRIPTION OF DRAWINGS

FIG. 4 is a perspective view of a mold that is constructed to permit the plastic blow molding of the bottle with the dispensing spout and moat construction illustrated in FIGS. 1 through 3;

FIG. 5 is a partial view of the mold illustrated in a closed position defining a cavity in which the blow molding is performed;

BEST MODES FOR CARRYING OUT THE INVENTION

Figure 1:
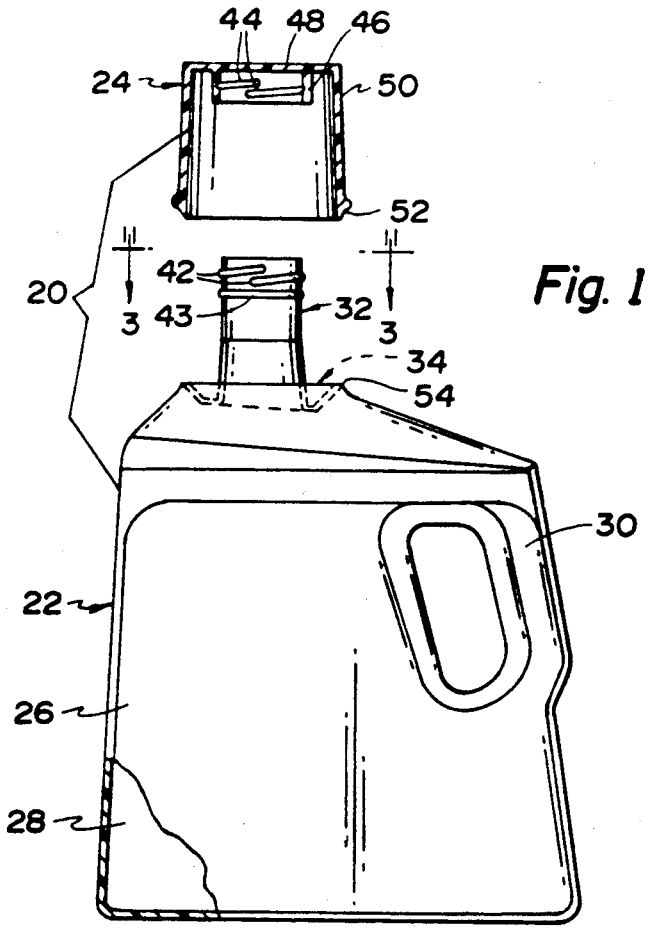
FIG. 1 is an elevational view of a container constructed in accordance with the present invention.

With reference to FIG. 1, a container constructed in accordance with the present invention is generally indicated by 20 and includes a unitary plastic blow molded bottle 22 and a measuring cup 24 that cooperate to provide dispensing of measured amounts of liquid contents as is hereinafter more fully described. The blow molded bottle includes a hollow body portion 26 whose interior 28 is designed to hold liquid contents. Body portion 26 of the blow molded bottle is also illustrated as being of the type including a handle 30 for ease in tilting the filled bottle to provide dispensing. However, it should be appreciated that the invention is also applicable to other designs which do not incorporate any handle for the bottle.

Figure 2:
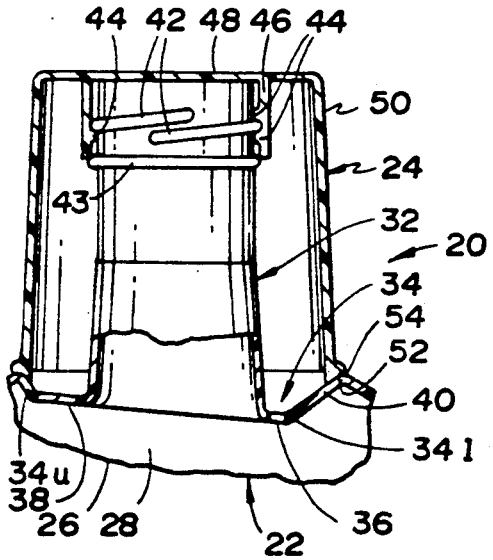
FIG. 2 is a partial sectional view taken in the same direction as FIG. 1 and illustrating a dispensing spout and moat of a blow molded bottle of the container and also illustrating a measuring cup that is utilized therewith to provide closing of the blow molded bottle.
Figure 3:
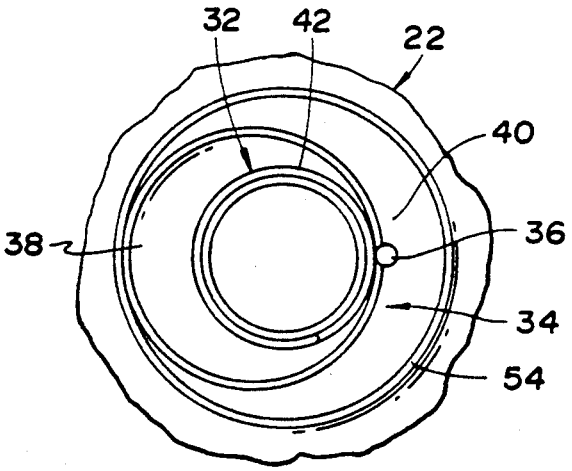
FIG. 3 is a top plan view taken along the direction of line 3—3 in FIG. 1 and further illustrates the construction of the dispensing spout and moat of the blow molded bottle.

With combined reference to FIGS. 1, 2, and 3, the blow molded bottle 22 also includes a dispensing spout 32 that projects upwardly from the body portion 26 to permit dispensing of the liquid contents by tilting of the filled bottle. A moat 34 of the unitary bottle 22 extends around the spout 32 and has an opening 36 communicated with the interior 28 of the hollow body portion 26 of bottle 22. As best illustrated in FIG. 2, the measuring cup 24 of the container is securable to the blow molded bottle in a sealed relationship about the moat 34 such that liquid contents remaining in the measuring cup upon securement to the bottle 22 will drain into the moat and through the opening 36 thereof into the hollow body portion 26 of the bottle.

The unitary construction of the plastic blow molded bottle 22 with the spout 32 and moat 34 is achieved by a blow molding operation which is hereinafter more fully described. This unitary construction permits a more economical container than those previously available wherein a transition collar made as plastic injection molding of either a one-piece or two-piece construction provides a similar drain-back function in association with a measuring cup.

The moat 34 preferably has a round shape as illustrated in FIG. 3 and is inclined as illustrated in FIG. 2 between an upper portion **34*u* of the moat and a lower portion 34*l* of the moat. The opening 36 of the moat is located at the lower portion 34*l* in order to maximize the drain-back operation of liquid from the measuring cup 24 into the interior 28 of the body portion 26** of the bottle.

As illustrated in FIGS. 2 and 3, the moat 34 includes a pair of inclined walls 38 and 40. Each of these inclined walls 38 and 40 as illustrated in FIG. 3 has a generally crescent shape oriented in the opposite direction as the crescent shape of the other moat wall. The one inclined wall 38 is smaller than the other inclined wall 40 and is located within the crescent shape of the latter. Both of the crescent shapes of the inclined walls 38 and 40 extend about the dispensing spout 32 through which the liquid contents of the bottle are poured into the measuring cup 24 for measured dispensing.

As shown in FIGS. 1 and 2, the dispensing spout 32 is illustrated as including at least one retainer 42 which preferably take the form of threads that are located above an annular bead 43 extend completely around the spout. Likewise, the measuring cup includes at least one retainer 44 that also preferably is embodied by threads that are mounted on an annular lip 46 projecting from a cup wall 48. An annular wall 50 of cup 24 extends from the perimeter of the wall 48 and includes a round sealing surface 52 at its lower end in the orientation illustrated, which is the upper end when the cup is turned over for use in measuring liquid contents to be dispensed. A round sealing surface 54 extends around the moat 34 and is engaged by the sealing surface 52 of the cup 24 with the cup secured by the retainers 52 and 44 as illustrated in FIG. 2. When the closed container 20 is held in the upright position, all liquid thus drains from the cup 24 into moat 34 and through the opening 36 into the interior 28 of the body portion 26 of the blow molded bottle 22. Engagement between the upper end of the dispensing spout 32 and the cup wall 48 prevents liquid flow through the spout when the bottle is tilted with the cup secured in position. Any small amount of liquid that flows through the opening 36 into the interior of the cup 24 upon such tilting is prevented from flowing outwardly by the sealing engagement of the surfaces 52 and 54. Upon tilting of the closed container 20 back to the upright position, the liquid contents flow back into the bottle interior 28.

Container 20 is utilized by unthreading of the cup 24 from the bottle 22 whereupon the bottle is tilted to provided a measured amount of liquid in the measuring cup. After dispensing of the liquid from the measuring cup 24, the measuring cup is again secured to the bottle 22 as illustrated in FIG. 2 whereupon the remaining liquid in the measuring cup flows back into the interior of the bottle as previously described through the moat 34 and the opening 36.

It should be appreciated that the construction of the spout 32 and moat 34 cannot be provided by conventional blow molding since the moat surrounding the spout results in a die lock situation. The configuration of the mold necessary to define the moat about the spout produces this die lock situation by preventing the mold defining the requisite cavity from being opened without destroying the blow molded container at the moat area.

Figure 6:
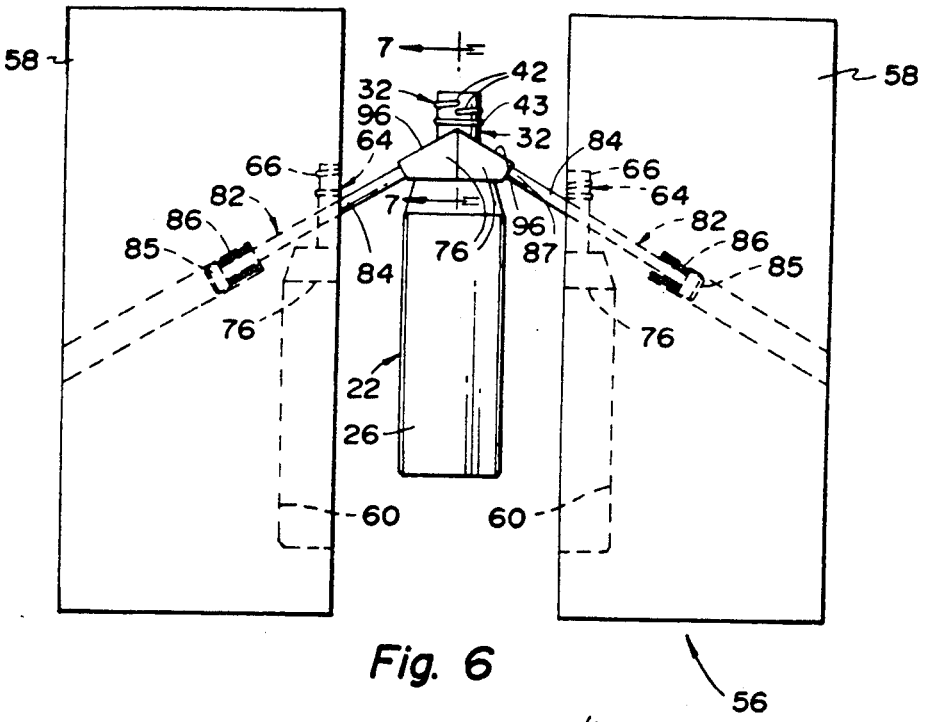
FIG. 6 is a view similar to FIG. 5 but with the mold in an open position after the bottle has been blow molded.

As illustrated in FIGS. 4 through 6, blow molding apparatus including a mold 56 performs the blow molding of the unitary plastic bottle 22 illustrated in FIGS. 1 through 3 without a die lock situation that prevents the mold from opening after the blow molding operation. Blow mold 56 includes mold sections 58 having cavity sections 60 that cooperatively define a mold cavity 62 in the closed position illustrated in FIG. 5. Each mold section 58 includes an associated insert assembly 64 that is constructed to permit the blow molding of the spout and moat construction without a die lock situation. The insert assemblies 64 each include a fixed insert 66 having a lower portion 68 that defines the spout retainer cavity configuration and having an upper blow cavity 70. As illustrated in FIG. 5, the left fixed insert 66 includes a first opening 72 through which a blow pin or needle is inserted to provide the blowing operation and also includes a second opening 74 through which an ejector pin is inserted to eject the molded part. Below its fixed insert 66, each insert assembly 64 also includes a movable insert 76 that permits the blow molding to be performed with the moat configuration without resulting in a die lock situation as is hereinafter more fully described.

Prior to the mold closing, an extruder 78 illustrated in FIG. 5 extrudes a parison of hot plastic in a tubular shape that is clamped between the mold sections 58 upon closing prior to the insertion of the blow pin through the insert opening 72 and the blowing that defines the container before the mold opening and ejection. In order to prevent heat buildup from the hot plastic, the fixed inserts 68 are provided with cooling passages 80 through which a cooling fluid flows to remove heat.

As illustrated in FIGS. 5 and 6, the movable insert 76 of each mold section 58 is supported for movement between the retracted position assumed with the mold closed as shown in FIG. 5 and the extended position assumed after the mold is opened as shown in FIG. 6. An insert positioner 82 illustrated in FIG. 6 is associated with each of the movable inserts 76 and includes a connecting pin 84 having a headed end 85 that is biased by an associated helical spring 86, as shown, or by a fluid cylinder. A second threaded end 87 of each connecting pin 84 is received by a threaded hole 88 (FIGS. 8 and 9) in the associated movable insert 76. The insert positioners 82 support the inserts 76 for inclined movement with respect to the direction of opening and closing mold movement as illustrated.

Figure 7:
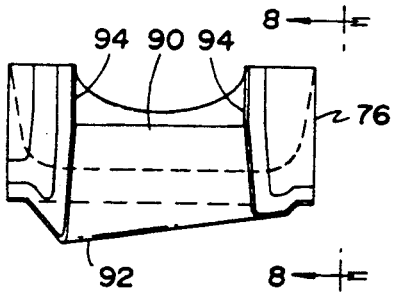
FIG. 7 is a view taken along the direction of line 7—7 in FIG. 6 to illustrate a movable insert that cooperates with another like movable insert to provide the spout and moat construction during the blow molding.
Figure 8:
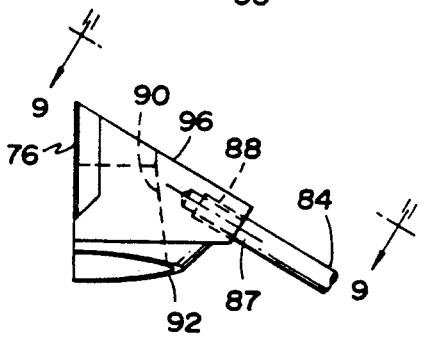
FIG. 8 is another view of the movable insert taken along the direction of line 8—8 in FIG. 7.
Figure 9:
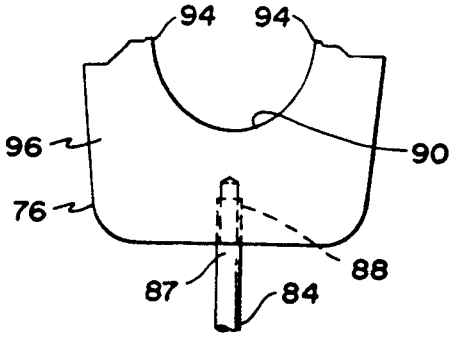
FIG. 9 is a further view of the insert taken along the direction of line 9—9 in FIG. 8.

With reference to FIGS. 7 through 9, each movable mold insert 76 has a semicircular cavity section 90 for defining the lower portion of the bottle spout during the molding. At its lower extremity, each movable insert 76 has a moat configuration 92 defining one half of the moat between its upper and lower portions as previously described. At opposite sides of the cavity section 90, the movable insert 76 like the rest of the mold includes a flash pinch edge 94 that pinches the plastic parison during the mold closing. At its upper extremity, each movable mold insert 76 has an inclined surface 96 that is received as illustrated in FIG. 5 by a slideway surface 98 of the associated fixed insert 66.

Each blow molding cycle for forming the container illustrated in FIGS. 1 through 3 commences with the mold in its open position as the extruder 78 supplies a hot plastic parison between the open mold sections 58. Movement of the mold sections 58 to the closed position illustrated in FIG. 5 then clamps the parison prior to the blowing that forms the plastic to the configuration of mold cavity 62 with the plastic being formed around the moat configurations 92 of the movable inserts 76. After the blowing operation has been performed and sufficient cooling time has taken place, the mold 56 is opened by movement of the mold sections 58 away from each other to the position of FIG. 6. As the mold opening is performed, the configuration of each moat pulls each movable insert 76 from the retracted position to the extended position as illustrated. After the mold opening is sufficient so that the blow molded bottle 22 is free for movement between the open mold sections 58, the bottle moves downwardly a slight amount which permits the bias of the positioners 82 to initiate movement of the mold inserts 76 back toward the retracted position. Such downward movement of the bottle 22 and retraction of the movable mold inserts 76 proceeds until the bottle is free of the movable mold inserts as these inserts are moved by the positioners 82 under the bias of springs 86 or associated fluid cylinders back to the retracted position.

The manner in which the blow molding is performed thus permits the provision of the spout 32 surrounded by the moat 34 of the unitary bottle 22 in a manner that has not heretofore been possible with plastic blow molding.

Figure 10:
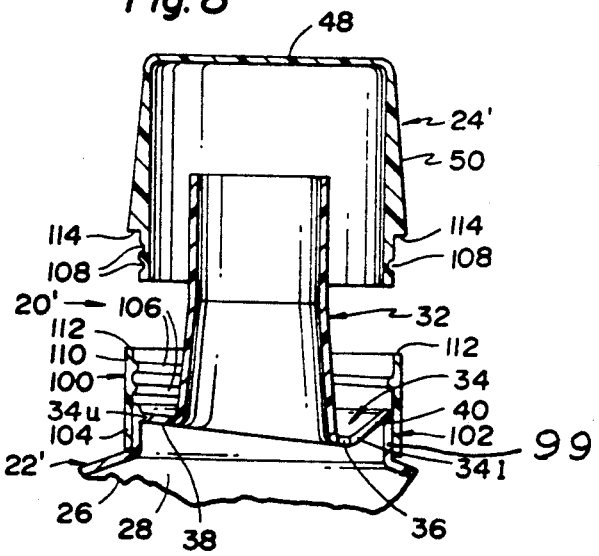
FIG. 10 is a partial sectional view of another embodiment of the container.

With reference to FIG. 10, another embodiment 20' of the container includes a blow molded bottle 22' which also includes a spout 32 and moat 34 formed unitary with the body portion 26 as well as including an annular wall 99 that extends vertically in an upward direction and has an outer surface. This embodiment of the bottle 22' also includes an annular insert 100 that extends around the moat 34 and is preferably injection molded from plastic. An annular ring portion 102 of the bottle 22' extends around the moat with a lower end 104 of the insert 100 having an inner surface thereof secured to the outer surface of wall 99 in any suitable manner such as by a spin welding operation, a suitable adhesive, or suitable retainers such as threads etc. Insert 100 also includes an upper end having an inner surface including at least one retainer 106 that is preferably embodied by a helical thread. Measuring cup 24' of the container 20' has its annular wall 50 provided with at least one retainer 108 which, like the insert retainer 106, is preferably embodied by a helical thread. The cup retainer 108 is secured by the retainer 106 on insert 100 to secure the measuring cup 24' to the bottle. As with the previously described embodiment, upon such securement, any liquid contents remaining in the measuring cup will drain into the moat 34 and through its opening 36 back into the interior 28 of the blow molded bottle 22'

With continuing reference to FIG. 10, the annular insert 100 has an upper end 110 including a round sealing surface 112 that faces upwardly in an axial direction with respect to the helical thread retainers 106. Likewise, the annular wall 50 of the measuring cup 24' has a round sealing surface 114 that faces downwardly in alignment with the round sealing surface 112 on the annular insert 110 of the blow molded bottle 22'. Upon securement of the measuring cup 24' by threading engagement of the retainers 106 and 108, the sealing surfaces 112 and 114 engage each other to seal the container and thereby prevent any leakage of the liquid contents.

While the best modes for carrying out the invention have been described in detail, those familiar with the art to which this invention relates will recognize various alternative designs and embodiments for practicing the invention as defined by the following claims.

What is claimed is:

1. A drain-back container for dispensing liquid contents, comprising:

a plastic blow molded bottle of a unitary, integral, one-piece construction including: (a) a hollow body portion for receiving the liquid contents, (b) an annular wall that projects vertically in an upward direction from the body portion, said annular wall having an outer surface, (c) a moat wall structure that extends inwardly from the annular wall, and (d) a dispensing spout that projects upwardly from the moat wall structure within the annular wall to provide dispensing of the liquid contents upon tipping of the bottle; and a plastic insert of an annular shape having a lower end including an inner surface secured to the outer surface of the annular wall of the bottle, the insert cooperating with the moat wall structure of the bottle to define a moat that extends around the dispensing spout and has an opening into the interior of the body portion, and the insert including an upper end having an inner surface including a retainer for securing a measuring cup that functions as a closure over the dispensing spout such that excess liquid contents from the measuring cup drain into the moat and through the opening thereof into the interior of the hollow body portion.

2. A drain-back container as in claim 1 wherein the retainer is a helical thread.

3. A drain-back container as in claim 1 wherein the annular wall of the bottle has a vertically extending cylindrical construction, and the plastic insert having a vertically extending cylindrical construction.

4. A drain-back container as in claim 1 or 3 wherein the connection of the insert is a spin welded connection.

5. A drain-back container for dispensing liquid contents, comprising:

a plastic blow molded bottle of a unitary, integral, one-piece construction including: (a) a hollow body portion for receiving the liquid contents, (b) an annular wall of a cylindrical shape that projects vertically in an upward direction from the body portion and has an outer surface, (c) a moat wall structure that extends inwardly from the annular wall, and (d) a dispensing spout that projects upwardly from the moat wall structure within the annular wall to provide dispensing of the liquid contents upon tipping of the bottle; and a plastic insert of an annular shape having a lower end including an inner surface having a connection to the outer surface of the annular wall of the bottle, the insert cooperating with the moat wall structure of the bottle to define a moat that extends around the dispensing spout and has an opening into the interior of the body portion, and the insert including an upper end having an inner surface having a retainer including a helical thread for securing a measuring cup that functions as a closure over the dispensing spout such that excess liquid contents from the measuring cup drain into the moat and through the opening thereof into the interior of the hollow body portion.

6. A drain-back container for dispensing liquid contents, comprising:

a plastic blow molded bottle of a unitary, integral, one-piece construction including: (a) a hollow body portion for receiving the liquid contents, (b) an annular wall of a cylindrical shape that projects vertically in an upward direction from the body portion and has an outer surface, (c) a moat wall structure that extends inwardly from the annular wall, and (d) a dispensing spout that projects upwardly from the moat wall structure within the annular wall to provide dispensing of the liquid contents upon tipping of the bottle; and a plastic insert of an annular shape having a lower end including an inner surface having a spin welded connection to the outer surface of the annular wall of the bottle, the insert cooperating with the moat wall structure of the bottle to define a moat that extends around the dispensing spout and has an opening into the interior of the body portion, and the insert including an upper end having an inner surface including an internal helical thread for securing a measuring cup that functions as a closure over the dispensing spout such that excess liquid contents from the measuring cup drain into the moat and through the opening thereof into the interior of the hollow body portion.

* * * * *